United States Patent [19]

Deutsch

[11] Patent Number: 4,866,912

[45] Date of Patent: Sep. 19, 1989

[54] METHOD OF AN APPARATUS FOR PACKING ROD-SHAPED ARTICLES OF THE TOBACCO PROCESSING INDUSTRY

[75] Inventor: Reinhard Deutsch, Geesthacht, Fed. Rep. of Germany

[73] Assignee: Körber AG, Hamburg, Fed. Rep. of Germany

[21] Appl. No.: 207,294

[22] Filed: Jun. 15, 1988

[30] Foreign Application Priority Data

Jun. 19, 1987 [DE] Fed. Rep. of Germany ..... 3720290
Jul. 11, 1987 [DE] Fed. Rep. of Germany ..... 3722999

[51] Int. Cl.[4] ..... B65B 19/22

[52] U.S. Cl. ..... 53/449; 53/466; 53/233; 53/234; 53/176

[58] Field of Search ..... 53/148, 225, 234, 233, 53/176, 170, 449, 466

[56] References Cited

U.S. PATENT DOCUMENTS

| | | | |
|---|---|---|---|
| 2,243,633 | 5/1941 | Jones | 53/233 X |
| 3,545,172 | 12/1970 | Osterdahl | 53/233 X |
| 3,899,865 | 8/1975 | Revaz | 53/234 |
| 3,992,855 | 11/1976 | Palmieri | 53/234 X |
| 4,352,265 | 10/1982 | Hansel | 53/234 X |

*Primary Examiner*—John Sipos
*Attorney, Agent, or Firm*—Peter K. Kontler

[57] ABSTRACT

Apparatus for draping blanks around blocks of parallel cigarettes has a continuously driven turret with radially inwardly extending pockets in its peripheral surface. Successive pockets of the turret receive blocks of cigarettes from successive pockets of a first endless belt or chain conveyor which partially overlies the peripheral surface of the turret and carries pushers which transfer the blocks into the pockets of the turret in the region of overlap. First blanks are caused to overlie the pockets of the turret ahead of the region of overlap so that the blocks deform the blanks during transfer into the pockets of the turret. The blanks are provided with flaps and tucks during travel with the turret, and the latter is further overlapped by a portion of a second endless belt or chain conveyor whose pockets receive blocks and the at least partially draped first blanks from the pockets of the turret in the region where the second conveyor overlaps the peripheral surface of the turret. Second blanks are placed across the pockets of the turret ahead of the region of overlap with the second conveyor, and such second blanks are automatically draped around the blocks and the respective first blanks during transfer of blocks and first blanks from the pockets of the turret into the pockets of the second conveyor. The pockets of the conveyors and of the turret receive blocks in such orientation that the respective cigarettes are moved sideways.

29 Claims, 2 Drawing Sheets

METHOD OF AN APPARATUS FOR PACKING ROD-SHAPED ARTICLES OF THE TOBACCO PROCESSING INDUSTRY

BACKGROUND OF THE INVENTION

The invention relates to improvements in methods of and in apparatus for manipulating groups or arrays of rod-shaped articles of the tobacco processing industry. More particularly, the invention relates to improvements in methods of and in apparatus for packing block-shaped arrays of plain or filter cigarettes, cigarillos, cigars, cheroots or other rod-shaped articles of the tobacco processing industry. Still more particularly, the invention relates to improvements in methods of and in apparatus for draping block-shaped arrays of cigarettes or the like into blanks of paper, cardboard, metallic foil, plastic foil or other sheet material.

It is known to drape arrays of cigarettes or like rod-shaped articles into blanks of paper, metallic foil or the like while the arrays are held by a rotary turret in a packing machine. Packing machines of such type are described and shown, for example, in commonly owned U.S. Pats. Nos. 3,956,870 to Kruse et al. 4,548,019 to Kruse, 3,735,767 to Kruse et al., 3,750,676 to Kruse et al., and 3,805,477 to Kruse et al. Arrays of cigarettes or like rod-shaped articles of the tobacco industry can be assembled in a manner as disclosed, for example, in commonly owned U.S. Pats. Nos. 4,362,235 to Erdmann, 4,471,866 to Erdmann et al., and 4,503,967 to Erdmann et al. Blanks are or can be obtained by subdividing elongated webs of suitable wrapping material into individual portions of required length, for example, by resorting to severing apparatus of the type disclosed in commonly owned U.S. Pat. No. 3,757,624 to Kruse et al. The disclosures of the above-enumerated patents are incorporated herein by reference.

OBJECTS AND SUMMARY OF THE INVENTION

An object of the invention is to provide a novel and improved method of draping blanks of foldable wrapping material around arrays or groups of rod-shaped articles of the tobacco processing industry at a rate higher than in accordance with heretofore known methods.

Another object of the invention is to provide a method which renders it possible to provide arrays or rod-shaped articles with envelopes of foldable wrapping material in a small area and at a frequency exceeding that which is achievable in accordance with heretofore known methods.

A further object of the invention is to provide a novel and improved method of advancing, transferring and/or otherwise moving arrays of rod-shaped articles of the tobacco processing industry in a packing machine.

An additional object of the invention is to provide a method which renders it possible to manipulate arrays of rod-shaped articles and blanks while the articles are continuously advanced along a predetermined path.

Still another object of the invention is to provide a method which renders it possible to drape blanks around block-shaped groups or arrays of rod-shaped articles in such a way that the articles are not defaced and/or otherwise damaged and that the configuration of the arrays remains unchanged.

A further object of the invention is to provide a novel and improved method of transferring groups or arrays of rod-shaped articles between different sections of a composite multiple-section path.

An additional object of the invention is to provide a method which renders it possible to apply to each of a series of successive arrays several discrete blanks in rapid sequence and in such a way that the application of a next-following blank does not adversely influence the configuration of the previously applied blank or blanks.

Another object of the invention is to provide a novel and improved apparatus for the practice of the above outlined method.

An additional object of the invention is to provide a packing machine for cigarettes or other rod-shaped articles of the tobacco processing industry which employs the above outlined apparatus.

Still another object of the invention is to provide the apparatus with novel and improved means for advancing, transferring and/or otherwise moving arrays of rod-shaped articles of the tobacco processing industry.

A further object of the invention is to provide the apparatus with novel and improved means for delivering blanks to requisite positions with reference to the arrays of rod-shaped articles and with novel and improved means for deforming the delivered blanks to thus convert the blanks into envelopes for the respective arrays.

Another object of the invention is to provide a system of advancing, transferring and other moving means for the arrays of rod-shaped articles which renders it possible to complete the draping of several blanks around each of a short or long series of arrays with a high degree of predictability, in a small area and at a frequency which at least matches but can considerably exceed that in recent types of machines for packing cigarettes or other rod-shaped articles of the tobacco processing industry.

A further object of the invention is to provide novel and improved means for advancing arrays of rod-shaped articles to and from the wrapping station or stations.

One feature of the present invention resides in the provision of a method of wrapping into blanks arrays or groups of rod-shaped articles of the tobacco processing industry (for example, arrays of twenty parallel cigarettes in the customary quincunx formation). The method comprises the steps of continuously advancing a series of successive arrays in a first direction along a first section of an elongated path, transferring successive arrays of the series from the first section into a second section of the path including moving the arrays substantially transversely of the first direction, and placing or delivering a blank in front of each array prior to the moving step so that the blanks are at least partially draped around the respective arrays in the course of the moving step. The advancing step can include advancing the arrays of the series in the form of at least one file of substantially equidistant arrays. The arrays are advanced at a predetermined speed, and the placing or delivering step includes conveying the blanks with the respective arrays at the predetermined speed in the course of the moving step.

Each array includes a plurality of parallel elongated rod-shaped articles, and the advancing and transferring steps preferably include moving the arrays at right angles to the longitudinal directions of the respective articles.

The method further comprises the step of conveying successive arrays of the series and the respective blanks along the second section of the path in a second direction at right angles to the longitudinal direction of the respective articles. The conveying step is preferably a continuous conveying step, and the method can further comprise the step of continuing the draping of arrays into blanks in the course of the continuous conveying step.

The method can comprise the additional steps of transferring successive arrays of the series and the at least partially draped blanks from the second into a third section of the path including moving the arrays substantially transversely of the second direction, and placing or delivering a second blank in front of each array prior to moving the arrays transversely of the second direction so that the second blanks are at least partially draped around the respective arrays in the course of transfer into the third section of the path. The arrays and the respective blanks are or can be continuously advanced along the third section of the path. The first, second and third sections of the path preferably define a substantially Z-shaped course for the arrays of rod-shaped articles.

Each array is preferably a block of the type having two parallel major surfaces (corresponding to the two largest surfaces of a standard cigarette pack), a pair of parallel second surfaces which extend at right angles to the major surfaces (these second surfaces are the two elongated narrow surfaces which alternate with and have the same length as the major surfaces of a standard cigarette pack), and a pair of parallel third surfaces which are disposed at right angles to the major surfaces as well as at right angles to the second surfaces (these third surfaces are those at the two ends of a standard cigarette pack). The advancing and conveying steps preferably include moving the arrays at right angles to their major surfaces, and the transferring steps preferably include moving the arrays at right angles to their second surfaces.

Another feature of the invention resides in the provision of an apparatus for wrapping into suitable blanks (of paper, metallic or plastic foil, cardboard or the like) block-shaped arrays of rod-shaped articles of the tobacco processing industry. The apparatus comprises a feeding unit including means (such as at least one endless flexible conveyor) for advancing a series of successive arrays in a first direction along a first elongated path section and having first pockets for the arrays, a conveyor having second pockets which circulate in a second direction along an endless second path section having a portion adjacent a portion of the first section, and means for driving the conveyor and the advancing means in synchronism so that successive first pockets reaching the aforementioned portion of the first path section register with successive second pockets which reach the aforementioned portion of the second path section.

The apparatus preferably further comprises a removing unit which comprise endless means (such as at least one second endless belt conveyor) for advancing successive arrays of the series in a third direction along a third path section having a portion adjacent a second portion of the second section (downstream of the first named portion of the second section, as seen in the second direction). The advancing means of the removing unit has third pockets for the arrays, and such apparatus further comprises means for driving the advancing means of the removing unit in synchronism with the conveyor so that successive second pockets reaching the second portion of the second path section register with successive third pockets which reach the aforementioned portion of the third path section. The driving means preferably include means for continuously driving the conveyor and the advancing means.

The conveyor can include a rotary turret and the second pockets, as well as the first and third pockets in the aforementioned portions of the respective (first and third) path sections are preferably disposed substantially radially of the turret. The second pockets preferably extend substantially radially inwardly from the peripheral (external) surface of the turret, and such peripheral surface is or can be a circular cylindrical surface.

The apparatus further comprises means for transferring arrays of rod-shaped articles from successive first pockets in the aforementioned portion of the first path section into the registering second pockets, and means for transferring arrays from successive second pockets in the second portion of the second path section into registering third pockets. The transferring means can include pushers which are movable radially of the turret in the aforementioned portion of the first path section and in the second portion of the second path section.

The apparatus further comprises a source of (first) blanks and means for delivering blanks from the source to the conveyor so that each second pocket which approaches the aforementioned portion of the first path section is overlapped by a blank and such blank is at least partially draped around the array which is being transferred into the respective second pocket. The delivering means can comprise means for depositing blanks of the peripheral (external) surface of the turret, and the conveyor can include means for urging the blanks against the peripheral surface of the turret. Such urging means can comprise suction ports in the peripheral surface of the turret and means for drawing air into the ports.

A portion of the endless flexible conveyor which constitutes or forms part of the advancing means of the feeding unit preferably overlaps a portion of the peripheral surface of the turret and defines the aforementioned portion of the first path section. The feeding unit can further comprise a fixed track for the portion of the endless flexible conveyor of advancing means of the feeding unit. Such endless flexible conveyor can comprise at least one row of rolls or otherwise configurated followers which can travel in grooves or channels defined by the track of the feeding unit. Analogously, the endless flexible conveyor of advancing means of the receiving unit can have a portion which overlaps a portion of the peripheral surface of the turret downstream (as seen in the second direction) of the locus where the endless flexible conveyor of the advancing means of the feeding unit overlaps the peripheral surface of the turret, and the removing unit can further comprise a fixed track for the just mentioned portion of the endless flexible conveyor of advancing means of the removing unit (such track can be identical with or similar or analogous to the track of the feeding unit).

If the arrays are of the type having the aforementioned pairs of first or major, second and third surfaces, the first, second and third pockets are preferably designed to snugly receive arrays of rod-shaped articles and have open sides which are adjacent one of the second surfaces of the arrays in the respective pockets.

As mentioned above, the second section of the composite path which is defined by the conveyor and the two advancing means is preferably circular, and the three sections preferably define a substantially Z-shaped course for the arrays.

The apparatus can further comprise means for draping (first) blanks around the arrays which are fully received in the respective second pockets, and such draping means can comprise means for providing the blanks with folds and/or tucks of the type customarily found on the envelopes of cigarette packs or packs of other rod-shaped smokers' products. The apparatus can also comprise means for draping second blanks around arrays in the third pockets, and such draping means can include means for providing the second blanks with folds and/or tucks.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
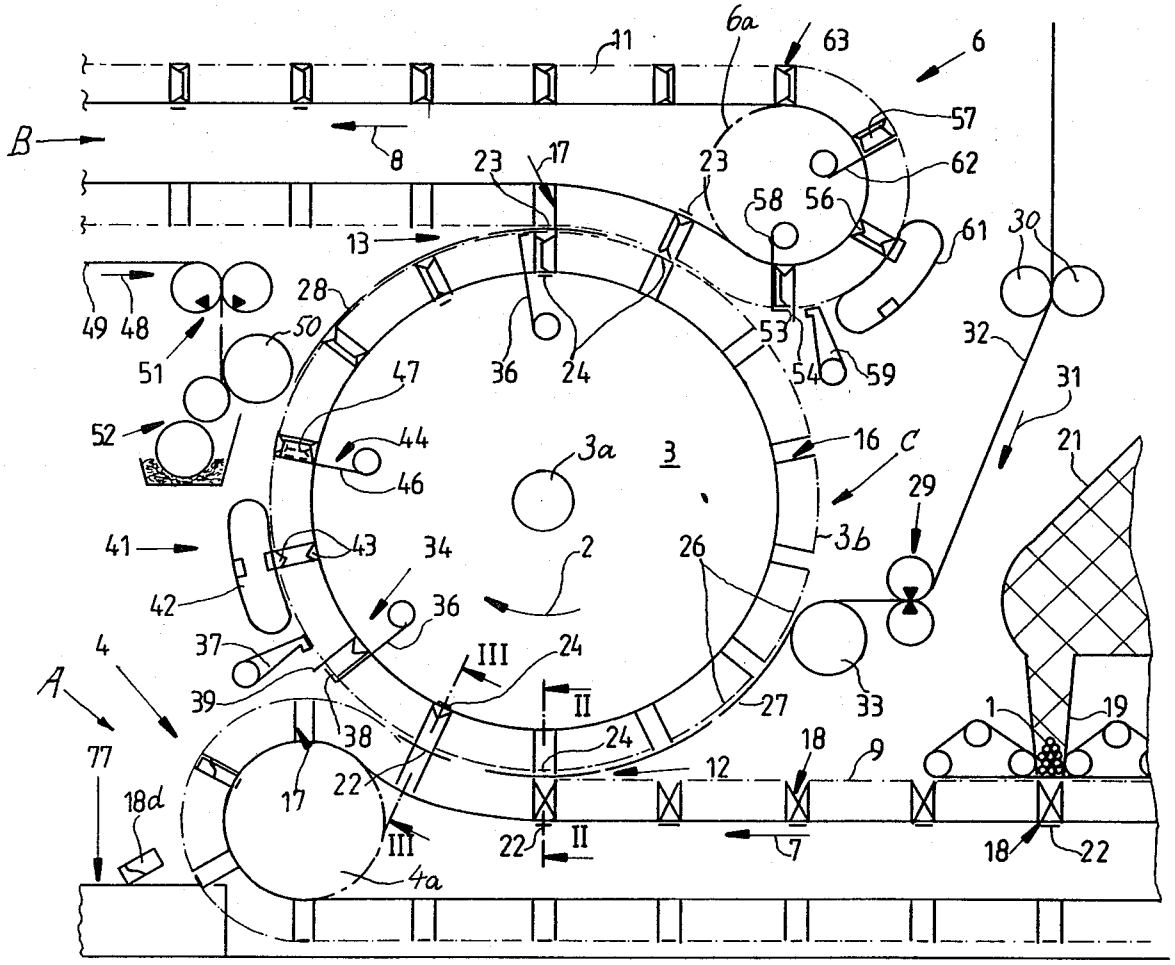
FIG. 1 is a schematic elevational view of an apparatus which embodies one form of the invention and is designed to provide each array of rod-shaped articles with two envelopes of foldable wrapping material.
Figure 3:
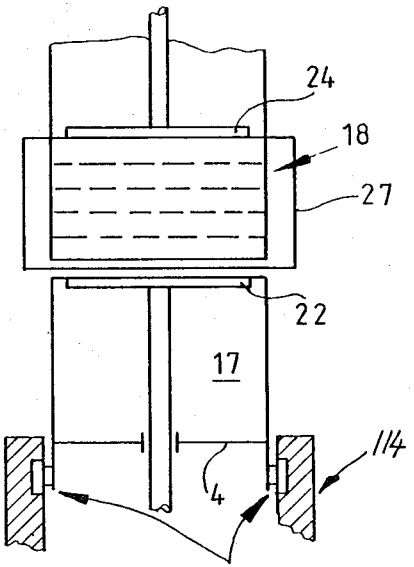
FIG. 3 is an enlarged fragmentary sectional view as seen in the direction of arrows from the line III—III of FIG. 1.
Figure 2:
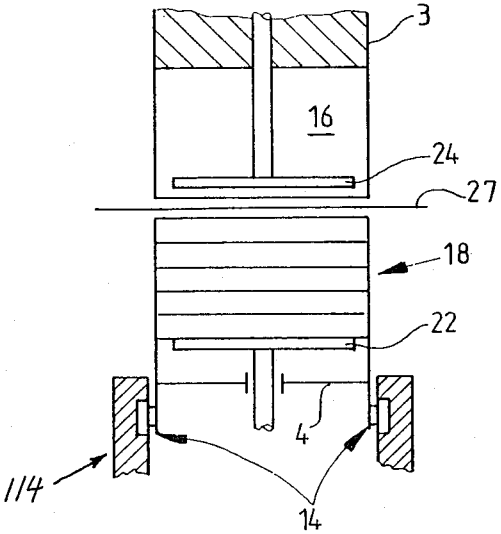
FIG. 2 is an enlarged fragmentary sectional view as seen in the direction of arrows from the line II—II of FIG. 1.

The apparatus which is shown in FIGS. 1 to 3 comprises a feeding unit A for unwrapped block-shaped groups or arrays 18 of cigarettes 1, a removing unit B for partly or fully wrapped arrays (packets) 63, and a conveyor C between the units A and B. The units A, B and the conveyor C jointly define a substantially Z-shaped course for the arrays 18 and their envelopes or wrappers. The feeding unit A comprises advancing means 4 in the form of an endless belt or chain conveyor which defines a first section of an elongated path and is driven in the direction of arrow 7. The conveyor 4 is trained over several pulleys 4*a* (one indicated in FIG. 1 by phantom lines), and at least one of these pulleys is driven by a suitable prime mover in synchronism with a rotary cylindrical turret 3 forming part of the conveyor C. The means for driving the turret 3 in synchronism with the conveyor 4 includes a shaft 3*a*. The removing unit B comprises advancing means in the form of an endless belt or chain conveyor 6 which is trained over pulleys 6*a* (one indicated by phantom lines), and one of these pulleys is driven by the aforementioned prime mover or by another prime mover so that the conveyor 6 advances at the speed of the conveyor 4 and at the peripheral speed of the turret 3. The turret 3 and the conveyors 4, 6 are driven continuously. In the illustrated embodiment, the pulleys 4*a*, 6*a* and the turret 3 are driven to rotate about parallel horizontal axes, and the conveyor 6 is mounted at a level above the turret 3 and conveyor 4. The directions in which the turret 3 and the conveyor 6 are driven are respectively indicated by arrows 2 and 8.

The conveyor 4 has a number of equidistant receptacles (hereinafter called pockets) 17 for discrete arrays 18 of, for example, twenty parallel cigarettes 1 each, and the upper reach 9 of the conveyor 4 advances successive filled pockets 17 in the direction of arrow 7 toward that portion 12 of the path section defined by the conveyor 4 which overlaps a portion of the circular path section defined by the turret 3. The latter has radially extending equidistant pockets 16 each of which can snugly receive an array 18, the same as the pockets 17 of the conveyor 4. The feeding unit A further comprises a fixed track 114 (see FIGS. 2 and 3) for roller followers 14 which are provided on the conveyor 4 in the region of the portion 12 of the respective path section to ensure that a concave portion of the conveyor 4 overlies the adjacent portion of the cylindrical peripheral (external) surface 3*b* of the turret 3. Other forms of fixed tracks can be used with equal or similar advantage. All that counts is to ensure that successive filled pockets 17 of the conveyor 4 in the portion 12 of the path section defined by the conveyor 4 register with successive empty pockets 16 of the turret 3. The pockets 16 extend radially inwardly from the peripheral surface 3*b* of the turret 3.

A portion of the lower reach or stretch of the conveyor 6 overlies a second portion of the path section which is defined by the turret 3, as at 13, and successive empty pockets 17 of the conveyor 6 register with successive filled pockets 16 of the turret 3 when such empty and filled pockets 17, 16 reach the portion 13 of the path section which is defined by the conveyor 6. The entire path for the arrays 18 extends from the illustrated leftmost duct 19 of a magazine 21 for cigarettes 1 to an ejecting station (not specifically shown in FIG. 1) which is adjacent the upper reach or stretch 11 of the conveyor 6 and wherein the wrapped arrays 18 are compelled to leave the respective pockets 17 of the conveyor 6. Such path includes a substantially or at least partially straight horizontal portion between the duct 19 and the six o'clock position of the turret 3, a substantially semicircular portion between the portions 12, 13 of the path sections defined by the conveyors 4, 6, and a partly looped and partly straight horizontal portion which is defined by the conveyor 6 downstream of the portion 13. The manner in which the right-hand portion of the lower reach of the conveyor 6 is compelled to overlap a portion of the peripheral surface 3*b* of the turret 3 is or can be the same as shown in FIGS. 2 and 3, i.e., the removing unit B also comprises a fixed track for roller followers which are provided on the conveyor 6 to ensure that successive empty pockets 17 of the conveyor 6 will be compelled to register with successive filled pockets 16 of the turret 3 when the apparatus of FIGS. 1 to 3 is in use.

Figure 4:
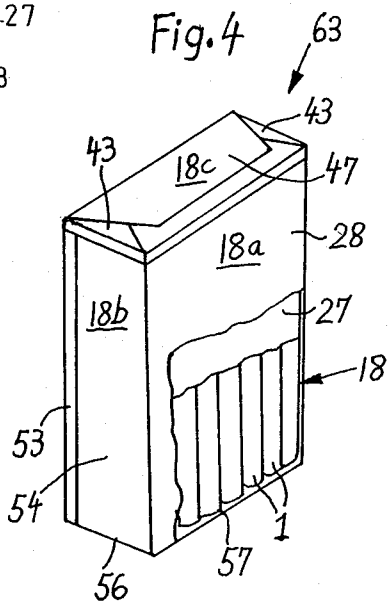
FIG. 4 is a perspective view of an array with an inner and an outer envelope, portions of the envelopes being broken away.

The mutual spacing of pockets 17 of the conveyors 4, 6 is the same as that of the pockets 16 in the turret 3. Furthermore, each of the pockets 16, 17 is dimensioned to snugly receive an array 18 in such orientation that one of the relatively narrow longitudinal (second) sides or surfaces 18*b* of an array 18 in a pocket 16 or 17 is adjacent an open side of such pocket. As can be seen in FIG. 4, each array 18 has two parallel major surfaces 18*a*, two narrower second surfaces 18*b* which extend at right angles to and alternate with the major surfaces 18*a*, and two parallel third surfaces 18*c* each of which extends at right angles to the major surfaces 18*a* as well as to the second surfaces 18*b*. The orientation of an array 18 in any of the pockets 17, 16, 17 in the conveyor 4, turret 3 and conveyor 6 is such that the arrays are advanced or conveyed at right angles to their major surfaces 18*a* (i.e., during movement with the conveyor 4 in the direction of arrow 7, during movement with the turret 3 in the direction of arrow 2, and during movement with the conveyor 6 in the direction of arrow 8).

The magazine 21 admits columns of parallel plain or filter cigarettes 1 into several upright or nearly upright ducts 19 to accumulate in successive oncoming pockets 17 in the upper reach 9 of the conveyor 4 a series of successive arrays or groups 18 which are then transported toward the portion 12 of the first section of the path for the arrays 18. The manner in which the conveyor 4 cooperates with the ducts 19 to accumulate a series of arrays 18 is or can be the same as or analogous to that disclosed in one of the aforementioned commonly owned U.S. Pats. Nos. 4,362,235 to Erdmann, 4,471,866 to Erdmann et al., and 4,503,967 to Erdmann et al. Each pocket 17 of the conveyor 4 is in alignment with a discrete transferring element 22 in the form of a pusher which is movable transversely of the adjacent portion of the conveyor 4 so as to be fully or partially received in or to be extracted from the respective pocket 17. The pushers 22 cooperate with the array forming means including the magazine 21 and its ducts 19 so as to prevent successive layers of cigarettes 1 from covering excessive distances during gravitational descent from successive ducts 19. Thus, a pusher 22 beneath the rightmost duct 19 (not shown in FIG. 1) of the magazine 21 is located close to the open upper side of the respective pocket 17 in the upper reach 9 of the conveyor 4, and such pusher then descends, either stepwise or continuously, so as to provide room for additional layers of cigarettes 1 in the respective pocket 17 as the pocket advances toward and to the position of alignment with the illustrated leftmost duct 19. The latter delivers the topmost layers of successive arrays or groups 18 so that the pushers 22 are fully withdrawn from the pockets 17 which advance beyond the illustrated duct 19 because such pockets are then filled with cigarettes 1, i.e., each pocket 17 contains a full array 18 of, for example, twenty parallel plain or filter cigarettes 1 in the customary quincunx formation. Of course, the apparatus can process with equal advantage other types of arrays, for example, arrays with three parallel layers of seven cigarettes each (or, otherwise stated, with seven parallel layers of three cigarettes each) or arrays with two parallel layers of ten cigarettes each.

The turret 3 carries or cooperates with radially movable pushers 23 which are analogous to the pushers 22 except that they are used in a different ways (namely to effect gradual and predictable transfer of successive arrays 18 from successive filled pockets 17 of the conveyor 4 into successive empty pockets 16 of the turret 3 (with simultaneous draping of first blanks 27 around the respective arrays 18) and to effect predictable transfer of arrays 18 and at least partially draped or deformed blanks 27 from successive filled pockets 16 of the turret 3 into successive empty pockets 17 of the conveyor 6 with simultaneous partial draping of second blanks 28 which at such time overlie the open sides of the pockets 17 in the lower reach of the conveyor 6. The conveyor 6 carries or moves in synchronism with additional pushers 23 which serve to cooperate with the pushers 23 in transferring arrays 18 and at least partially draped blanks 27 into the respective pockets 17 of the conveyor 6 as well as to expel packets 63 (each such packet includes an array 18 and two at least partially draped blanks 27, 28) from the respective pockets 17 of the conveyor 6.

The peripheral surface 3*b* of the turret 3 is provided with means for urging successive blanks 27 to overlie the open sides of successive empty pockets 16 not later than when such pockets reach the portion 12 of the path section which is defined by the conveyor 4. The urging means comprises suction ports 26 which are provided in the peripheral surface 3*b* and are connected to a suitable suction generating device (e.g., a suction fan, not shown) in a region between a rotary suction drum 33 and approximately the seven o'clock position of the turret 3. Each blank 27 which has been delivered to the turret 3 overlies the open outer side of the respective pocket 16 and is ready to be deformed by the array 18 which is to be transferred into the pocket 16 by the respective pusher 22 in cooperation with the respective pusher 24 so that the blank 27 is draped at least around three surfaces (namely two surfaces 18*a* and one surface 18*b*) of the respective array 18. Such transfer of arrays 18 from the conveyor 4 onto the turret 3 takes place transversely of directions which are indicated by the arrows 7 (conveyor 4) and 2 (turret 3).

The source of blanks 27 is a continuous web or strip 32 of paper, metallic foil, plastic foil or other suitable wrapping material for use in cigarette packs. The web 32 is drawn from a suitable reel (not shown) by two advancing rolls 30 in the direction of arrow 31 and is severed at required intervals by a severing device 29 which may be of the type disclosed in the aforementioned commonly owned U.S. Pat. No. 3,757,624 to Kruse et al. The suction drum 33 deposits or places successive blanks 27 onto the peripheral surface 3*b* of the turret 3 where the blanks 27 are attracted by the adjacent suction ports 26 to be maintained in optimum positions for partial draping around the respective arrays 18 during transfer of such arrays from successive pockets 17 of the conveyor 4 into successive pockets 16 of the turret 3. The manner in which the suction ports in the peripheral surface of the drum 33 and the suction ports 2*b* in the peripheral surface 3*b* of the turret 3 are connectable to and disconnectable from the respective suction generating means during different stages of each revolution of the drum 33 and turret 3 is well known from the art of making cigarette packs and the like and, therefore, such connecting/disconnecting means are not shown in the drawing.

An array 18 which is being transferred from the respective pocket 17 of the conveyor 4 into the registering pocket 16 of the turret 3 bears against the adjacent properly stretched blank 27 with one of its second surfaces 18*b* and pushes the median portion of the blank 27 into the respective pocket 16 to thereby convert the previously flat or substantially flat blank 27 into a substantially U-shaped body which overlies the two major surfaces 18*a* and one second surface 18*b* of the respective array 18. As mentioned above, such transfer of an array 18 into the registering pocket 16 of the turret 3 takes place transversely of the direction which are indicated by the arrows 7 and 2. The pusher 24 props the central portion of the blank 27 in the interior of the respective pocket 16 while the aligned pusher 22 moves transversely of the upper reach 9 of the conveyor 4 to push the array 18 from the respective pocket 17 and into the registering pocket 16. The pushers 22, 24 are moved in synchronism so as to prevent any deformation of the array 18 during transfer from the conveyor 4 onto the turret 3 as well as to ensure highly predictable conversion of the respective blank 27 into a substantially U-shaped body. The transfer of successive arrays 18 from the upper reach 9 of the conveyor 4 into the registering pockets 16 can begin at or close to the six o'clock position of the turret 3 and can be completed in the region of the line III—III of FIG. 1.

Each freshly transferred array 18 then advances in the direction of arrow 2 to enter a first folding or draping station 34 with draping, folding and/or tucking instrumentalities or tools 36 and 37. The tool 36 is pivotable in a clockwise direction to thereby form a flap 38 which overlies the still exposed surface **18*b* of the respective array 18, and the tool 37 is also pivotable in the clockwise direction to form a flap 39 which overlies the flap 38 and cooperates with the latter to fully conceal the respective second surface 18*b***.

The station 34 is followed by a second draping or folding station 41 with a tool or set of tools 42 which provide the blanks 27 with two pairs of tucks 43 which overlie portions of the third surfaces **18*c* of the respective arrays. A next-following folding or draping station 44 accommodates suitable folding or flexing tools 46 (only one shown) which fold the still outwardly projecting portions of the blanks 27 to form flaps 47 which overlie the respective tucks 43 and each other to thus complete the conversion of blanks 27 into hollow parallelepiped envelopes each of which completely surrounds the respective array 18**. This can be readily seen by inspecting commercially available soft cigarette packs.

The blanks 27 can constitute pieces of metallic foil with or without paper linings.

The source of second blanks 28 is a continuous web or strip 49 which can be made of paper or lightweight cardboard and is drawn off a suitable reel (not shown) by two advancing rolls (not shown) so that it runs in the direction of arrow 48. A suction drum 50 follows a severing device 51 which subdivides the web 49 into a series of blanks 28, and selected portions of such blanks are coated with a suitable adhesive by a paster 52 of any known design (such pasters are used extensively in the cigarette packing machines and are described in numerous United States and foreign patents of the assignee of the present application). The suction drum 50 places or deposits successive blanks 28 on the peripheral surface **3*b* of the turret 3 so that the blanks 28 overlie the open sides of the respective pockets 16 (i.e., the blanks 28 overlie the once draped arrays 18 in such pockets 16) and are attracted to the peripheral surface of the turret 3 by the adjacent suction ports 26**.

The folding tools 36 can serve as a means for holding the arrays 18 and the respective blanks 27 in the pockets 16 between the seven and twelve o'clock positions of the turret 3, and such tools are pivoted out of the way when they reach the second portion of the circular path section defined by the turret 3, namely the portion 13 of the path section which is defined by the conveyor 6. This enables the respective pushers 24 to cooperate with the aligned pushers 23 of the conveyor 6 so as to transfer the once draped arrays 18 from the pockets 16 into the registering pockets 17 (substantially between the twelve and one o'clock positions of the turret 3) whereby the once draped arrays 18 deform the respective blanks 28 and convert them into substantially U-shaped bodies which overlie three sides of the respective inner envelopes (converted blanks 27). The pushers 23 extend fully into the respective pockets 17 of the conveyor 6 when such pockets reach the twelve o'clock position of the turret 3, and the pushers 23 are thereupon extracted from their pockets 17 at the rate at which the aligned pushers 24 enter the respective pockets 16 to ensure a highly predictable transfer of once draped arrays 18 and simultaneous equally predictable deformation or partial draping of the second blanks 28. During such transfer, the once draped arrays 18 move transversely of the directions which are indicated by the arrows 2 and 8. The flaps 53, 54 of the partially draped second blanks 28 are thereupon folded over each other by folding or draping tools 58, 59 which are analogous to the draping tools 36, 37 at the station 34 but are adjacent the looped portion of the conveyor 6. The outer sides of the flaps 53 and/or the inner sides of the flaps 54 carry films of adhesive (which was applied by the paster 52) so that these flaps adhere to each other and convert the theretofore U-shaped partially draped blanks 28 into tubular bodies. A tucking tool 61 which follows the tools 58, 59 serves to provide a pair of tucks 56 at one surface **18*c* of the respective once wrapped array 18, and one or more folding tools 62 then convert the adjacent protruding portions of successive blanks 28 into overlapping flaps which adhere to each other because at least one of these flaps carries a film of adhesive applied by the paster 52. The apparatus can be further equipped with conventional means (not shown) for applying a revenue label over the other surface 18*c* of each twice wrapped array 18 (packet 63) before the arrays are expelled from their pockets 17 (in the conveyor 6) by the aligned pushers 23. The ejected packets 63** can be admitted into a machine which provides them with third or outermost envelopes of transparent plastic material, and such third envelopes can be provided with customary tear strips in a manner not forming part of the present invention.

FIG. 1 further shows an ejecting station 77 for expulsion of defective arrays **18*d* from the respective pockets 17 of the conveyor 4. Such defective arrays are detected by one or more suitable monitoring devices of the type well known from the art of cigarette making and processing machines, and the signals from the monitoring device or devices are used to prevent the corresponding pushers 22 from entering the adjacent pockets 17 of the conveyor 4. However, such pushers 22 (or other suitable expelling means) are actuated at the ejecting station 77 to remove the defective arrays 18*d* from their pockets 17. For example, a defective array 18 will contain less than the prescribed number of cigarettes 1, or the cigarettes 1 at the one or the other end of a defective array 18*d*** will have frayed ends, open seams or unsatisfactory tobacco fillers.

An important advantage of the improved method and apparatus is that the arrays 18 cover very short distances on their way from the pockets 17 of the conveyor 4 into the pockets 16 of the turret 3 and from the pockets 16 of the turret 3 into the pockets 17 of the conveyor 6. This reduces the likelihood of distortion or other adverse influencing of the shape and/or other desirable characteristics of the arrays, and it also renders it possible to complete the draping of arrays into blanks in a small area and within short intervals of time, i.e., the arrays can be advanced to the turret 3 and draped on the turret and on the conveyor 6 at a frequency which is higher than in heretofore known packing machines the majority of which are still designed for intermittent operation. Gentle treatment of arrays 18 is desirable and advantageous in order to reduce the likelihood of escape of tobacco particles at the ends of the cigarettes 1. Such likelihood is further reduced due to the fact that the cigarettes 1 are invariably transported sideways, i.e., at right angles to their longitudinal axes, not only during advancement with the conveyors 4, 6 but also during transfer onto and from the turret 3 as well as during transport by the turret.

The provision of a substantially Z-shaped course for advancement of arrays 18 toward, with and beyond the turret 3 contributes to compactness of the apparatus. Compactness of the apparatus is enhanced still further because of the aforediscussed orientation of pockets 17 in the conveyors 4, 6 and pockets 16 in the turret 3. This renders it possible to place the pockets 17 in the conveyors 4, 6 and the pockets 16 in the peripheral surface **3*b* of the turret 3 close to each other while simultaneously preventing tobacco particles from escaping at the ends of the cigarettes 1** because the cigarettes are invariably transported sideways.

A further important advantage of the improved apparatus is that the arrays 18 need not undergo abrupt acceleration and/or deceleration because the conveyors 4, 6 advance the arrays at the speed of the turret 3 and the transfer of arrays 18 from the pockets 17 of the conveyor 4 into the pockets 16 of the turret 3 as well as from the pockets 16 of the turret 3 into the pockets 17 of the conveyor 6 takes place while the speed of the arrays (in the directions indicated by arrows 7, 2 and 8) remains unchanged. It has been found that the improved apparatus can turn out block-shaped packets 63 (each of which can constitute a customary soft cigarette pack) at a frequency which at least matches but can greatly exceed that in a conventional cigarette packing or like machine. In addition, the arrays and the blanks are treated gently so that the shape and dimensions of each of a short or long series of successively obtained packets 63 match the desired shape and dimensions.

An apparatus which can be used to monitor the arrays and to effect segregation of defective arrays **18*d*** is disclosed in commonly owned U.S. Pat. No. 4,486,098 granted Dec. 4, 1984 to Buchegger et al. The disclosure of this patent is incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of draping into blanks block-shaped arrays of deformable parallel elongated rod-shaped articles of the tobacco processing industry of the type having a pair of parallel major surfaces of a first width and a pair of parallel second surfaces having a lesser second width and disposed at right angles to the major surfaces and parallel to the articles, comprising the steps of continuously advancing a series of successive arrays in a first direction at right angles to the major surfaces of the arrays and at right angles to the axes of the articles along a first section of an elongated path; transferring successive arrays of said series from the first into a second section of the path without interrupting the advancement of said arrays, including moving the arrays substantially transversely of said first direction at right angles to the second surfaces and at right angles to the axes of the articles; and placing a blank in front of one second surface of each array prior to said moving step so that the blanks are at least partly draped around the one second surface and the major surfaces of the respective arrays in the course of the moving step.

2. The method of claim 1, wherein said advancing step includes advancing the arrays in the form of at least one file of substantially equidistant arrays.

3. The method of claim 1, wherein said advancing step includes advancing the arrays at a predetermined speed, and said placing step includes conveying the blanks with the respective arrays at said predetermined speed in the course of said moving step.

4. The method of claim 1, further comprising the steps of continuously conveying successive arrays of said series along the second section of said path, and continuing the draping of arrays into blanks int he course of said conveying step.

5. The method of claim 1, further comprising the steps of continuously conveying successive arrays of said series in a second direction along the second section of said path, transferring successive arrays of said series and the at least partially draped blanks from the second into a third section of said path, including moving the arrays substantially transversely of said second direction and at right angles to the axes of the articles, and placing a second blank in front of each array prior to said last named moving step so that the second blanks are at least partially draped around the respective arrays in the course of said last named moving step.

6. The method of claim 5, further comprising the step of continuously advancing the arrays and the respective blanks along the third section of said path.

7. The method of claim 5, wherein said first, second and third sections together form a substantially Z-shaped course for the arrays.

8. In an apparatus for draping into blanks block-shaped arrays of deformable parallel elongated rod-shaped articles of the tobacco processing industry wherein each array has a pair of parallel major surfaces of a first width and a pair of parallel second surfaces having a lesser second width and disposed at right angles to the major surfaces and parallel to the articles, the combination of a feeding unit comprising endless means for advancing a series of successive arrays in a first direction at right angles to the major surfaces of the arrays and at right angles to the axes of the articles along a first elongated path section, said advancing means including first pockets for the arrays and said first pockets having open sides adjacent the second surfaces of the arrays therein; a conveyor having second pockets arranged to circulate in a second direction along an endless second path section having a portion adjacent a portion of said first section; means for continuously driving said conveyor and said advancing means in synchronism so that successive first pockets reaching said portion of the first section register with successive second pockets reaching said portion of said second section; and means for transferring arrays from successive first pockets into successive second pockets at right angles to the axes of articles and at right angles to the second surfaces of the arrays without interrupting the advancement of said arrays, said second pockets having open sides adjacent the second surfaces of the arrays therein and the open side of each first pocket in said portion of said second path section being adjacent the open side of the registering second pocket so that the major surfaces of arrays are confined in part in the respective first pockets during transfer of arrays into said second pockets.

9. The structure of claim 8, further comprising a removing unit comprising endless means for advancing successive arrays of said series in a third direction along a third path section paving a portion adjacent a second portion of said second section, said advancing means of said removing unit having third pockets for the arrays, and means for driving said advancing means of said removing unit in synchronism with said conveyor so that successive second pockets reaching the second portion of said second section register with successive third pockets reaching said portion of the third section.

10. The structure of claim 9, wherein said conveyor includes a rotary turret and said second pockets as well as the first and third pockets in said portions of the first and second sections, respectively, are disposed substantially radially of said turret.

11. The structure of claim 10, wherein said turret has a peripheral surface and said second pockets extend radially inwardly from said peripheral surface.

12. The structure of claim 9, further comprising means for transferring arrays from successive second pockets in the second portion of said second section into registering third pockets.

13. The structure of claim 12, wherein said conveyor includes a rotary turret and said transferring means include pushers movable radially of the turret in said portion of the first section and in said second portion of the second section.

14. The structure of claim 12, further comprising a source of blanks and means for delivering blanks from said source to said conveyor so that each second pocket approaching said portion of said first section is overlapped by a blank and such blank is deformed to be at least partially draped around the one second surface and the major surfaces of the arrays which is transferred into the respective second pocket.

15. The structure of claim 14, wherein said conveyor has an external surface and said second pockets extend inwardly from said external surface, said delivering means including means for depositing blanks on said external surface.

16. The structure of claim 15, wherein said conveyor comprises means for urging the blanks against said surface.

17. The structure of claim 16, wherein said urging means includes suction ports provided in said surface.

18. The structure of claim 9, wherein said conveyor comprises a rotary turret and the advancing means of said feeding unit comprises an endless flexible conveyor having a portion overlapping a portion of the periphery of said turret and defining said portion of said first section.

19. The structure of claim 18, wherein said feeding unit includes a fixed track for said portion of said endless flexible conveyor.

20. The structure of claim 9, wherein said conveyor comprises a rotary turret and the advancing means of said removing unit comprises an endless flexible conveyor having a portion overlapping a portion of the periphery of said turret and defining said portion of said third section.

21. The structure of claim 20, wherein said removing unit includes a fixed track for said portion of said endless flexible conveyor.

22. The structure of claim 9 for draping block-shaped arrays each of which has two parallel third surfaces disposed at right angles to the major and second surfaces, said pockets being dimensioned to snugly receive the arrays in such orientation that one second surface of the array in a pocket is adjacent the open side of such pocket.

23. The structure of claim 9, further comprising a source of blanks, means for draping blanks at least partially around the arrays in said second pockets, and means for transferring arrays and the respective at least partially draped blanks from the second pockets in the second portion of the second section into the third pockets in said portion of the third section.

24. The structure of claim 9, wherein said second section is substantially circular.

25. The structure of claim 9, wherein said conveyor and said advancing means jointly define a substantially Z-shaped course for the arrays of said series.

26. The structure of claim 9, further comprising a source of blanks, means for delivering blanks from said source to said conveyor, and means for draping the blanks around the arrays in said second pockets.

27. The structure of claim 26, wherein said draping means comprises means for providing the blanks with flaps and tucks.

28. The structure of claim 9, further comprising a source of blanks, means for delivering blanks from said source to the advancing means of said removing unit, and means for draping the blanks around the arrays in said third pockets.

29. The structure of claim 28, wherein said draping means comprises means for providing the blanks with flaps and tucks.

* * * * *